US009039077B1

(12) United States Patent
Santamaria

(10) Patent No.: US 9,039,077 B1
(45) Date of Patent: May 26, 2015

(54) ADJUSTABLE LOUNGE CHAIR

(71) Applicant: Denise H. Santamaria, Hopelawn, NJ (US)

(72) Inventor: Denise H. Santamaria, Hopelawn, NJ (US)

( * ) Notice: Subject to any disclaimer, the term of this patent is extended or adjusted under 35 U.S.C. 154(b) by 0 days.

(21) Appl. No.: 14/101,586

(22) Filed: Dec. 10, 2013

(51) Int. Cl.
*A47C 1/14* (2006.01)
*A47C 4/28* (2006.01)
*A47C 4/30* (2006.01)
*A47C 7/72* (2006.01)

(52) U.S. Cl.
CPC ..... *A47C 7/72* (2013.01)

(58) Field of Classification Search
CPC ..... A47C 4/20; A47C 7/70
USPC ..... 297/31, 45, 344.18
See application file for complete search history.

(56) References Cited

U.S. PATENT DOCUMENTS 4,532,948 A * 8/1985 Burrows ..... 297/45 X
5,246,265 A 9/1993 Nagan et al.
5,271,422 A * 12/1993 Sorrell et al. ..... 297/45 X
5,494,333 A 2/1996 Wilson
5,522,642 A 6/1996 Herzog
6,056,353 A * 5/2000 Meara ..... 297/344.18 X
6,095,607 A 8/2000 Wenzel
6,213,555 B1 4/2001 Sulpizio et al.
6,439,659 B1 * 8/2002 Neubauer, Jr. ..... 297/45 X
6,523,894 B1 * 2/2003 Mellace ..... 297/188.19 X
6,698,830 B1 * 3/2004 Gaines ..... 297/344.18 X
6,921,135 B2 7/2005 Ellis et al.
6,935,694 B2 * 8/2005 Turner ..... 297/188.14 X
7,631,940 B1 12/2009 Jager
7,703,854 B2 * 4/2010 LaFreniere ..... 297/411.23
7,832,804 B2 * 11/2010 LaFreniere ..... 297/411.32
7,963,592 B1 * 6/2011 Stanley ..... 297/31
8,091,962 B2 * 1/2012 Quinn ..... 297/45 X
8,123,291 B1 * 2/2012 Hernandez ..... 297/31 X
8,465,090 B1 * 6/2013 O'Connor ..... 297/45
8,585,135 B2 * 11/2013 Wilson ..... 297/54
8,789,884 B1 * 7/2014 Edelman et al. ..... 297/188.13
8,794,699 B1 * 8/2014 Rudolfo ..... 297/344.18 X
8,801,091 B2 * 8/2014 Squires et al. ..... 297/45 X
8,864,221 B1 * 10/2014 Delvilla ..... 297/31
2010/0219665 A1 9/2010 Holloway et al.
2012/0313405 A1 * 12/2012 Eckman et al. ..... 297/180.12
2013/0328362 A1 * 12/2013 Miller ..... 297/188.2

FOREIGN PATENT DOCUMENTS

FR 2962311 1/2012

* cited by examiner

*Primary Examiner* — Rodney B White
(74) *Attorney, Agent, or Firm* — Kyle A. Fletcher, Esq.

(57) ABSTRACT

A chair assembly for selectively charging an electronic device includes a frame. A back portion of the frame is operationally coupled to a front portion of the frame. A supporting panel is coupled to the frame. The supporting panel may support a user. A leg is coupled to the frame. The leg abuts a support surface so the leg supports the frame above the support surface. An arm rest is operationally coupled to the frame. The arm rest may support the user's arm. A bag is coupled to the arm rest. The bag may contain the electronic device. A charger is operationally coupled to the arm rest. The charger is selectively operationally coupled to the electronic device. The charger may charge the electronic device.

19 Claims, 5 Drawing Sheets

ADJUSTABLE LOUNGE CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of chairs, more specifically, an improved lounge chair with an adjustment capability.

SUMMARY OF THE INVENTION

An embodiment of the disclosure meets the needs presented above by generally comprising a frame. A back portion of the frame is operationally coupled to a front portion of the frame. A supporting panel is coupled to the frame. The supporting panel may support a user. A leg is coupled to the frame. The leg abuts a support surface so the leg supports the frame above the support surface. An arm rest is operationally coupled to the frame. The arm rest may support the user's arm. A bag is coupled to the arm rest. The bag may contain the electronic device. A charger is operationally coupled to the arm rest. The charger is selectively operationally coupled to the electronic device. The charger may charge the electronic device.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
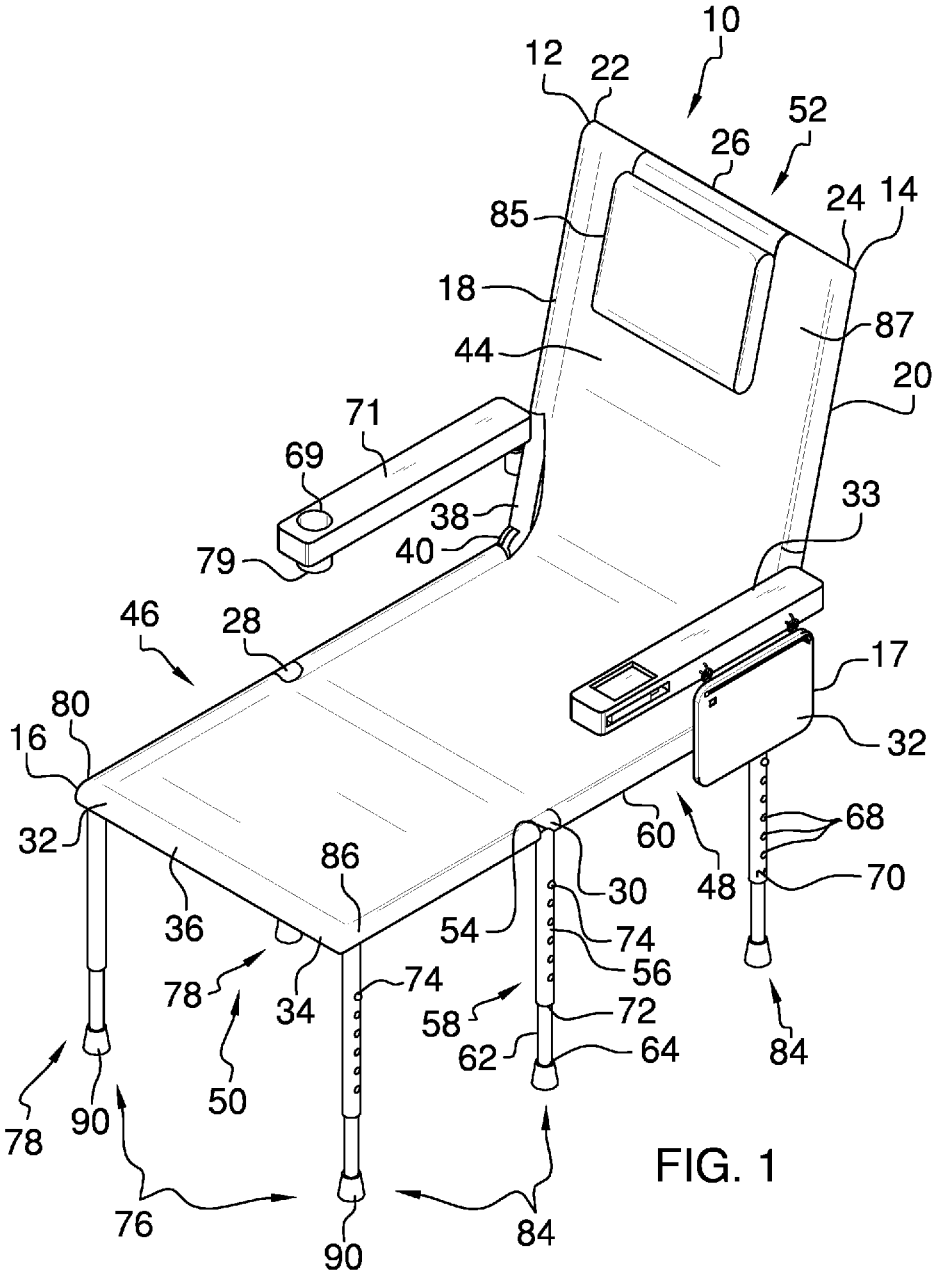
FIG. 1 is a top perspective view of a chair assembly according to an embodiment of the disclosure.
Figure 2:
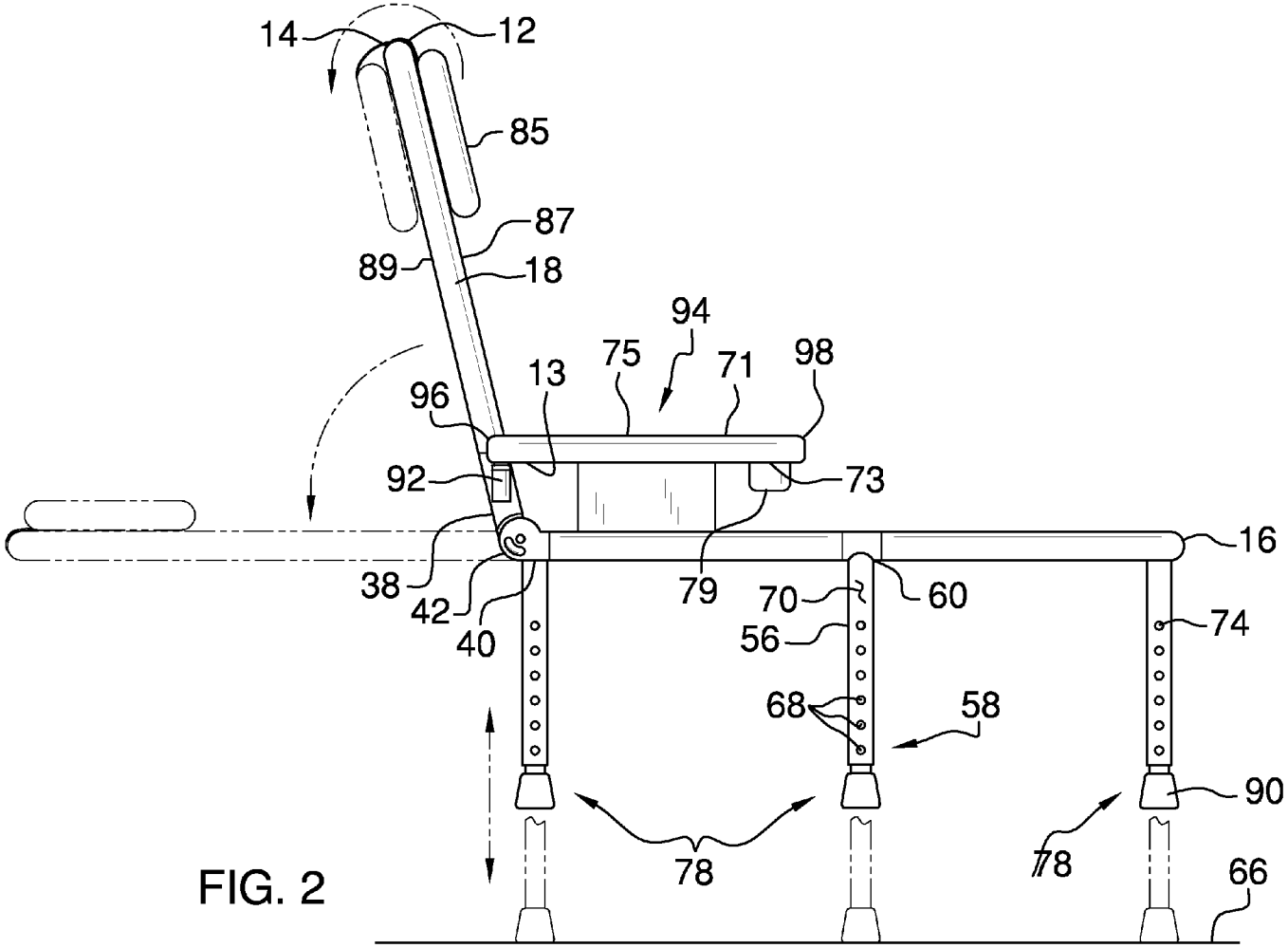
FIG. 2 is a right side view of an embodiment of the disclosure.
Figure 3:
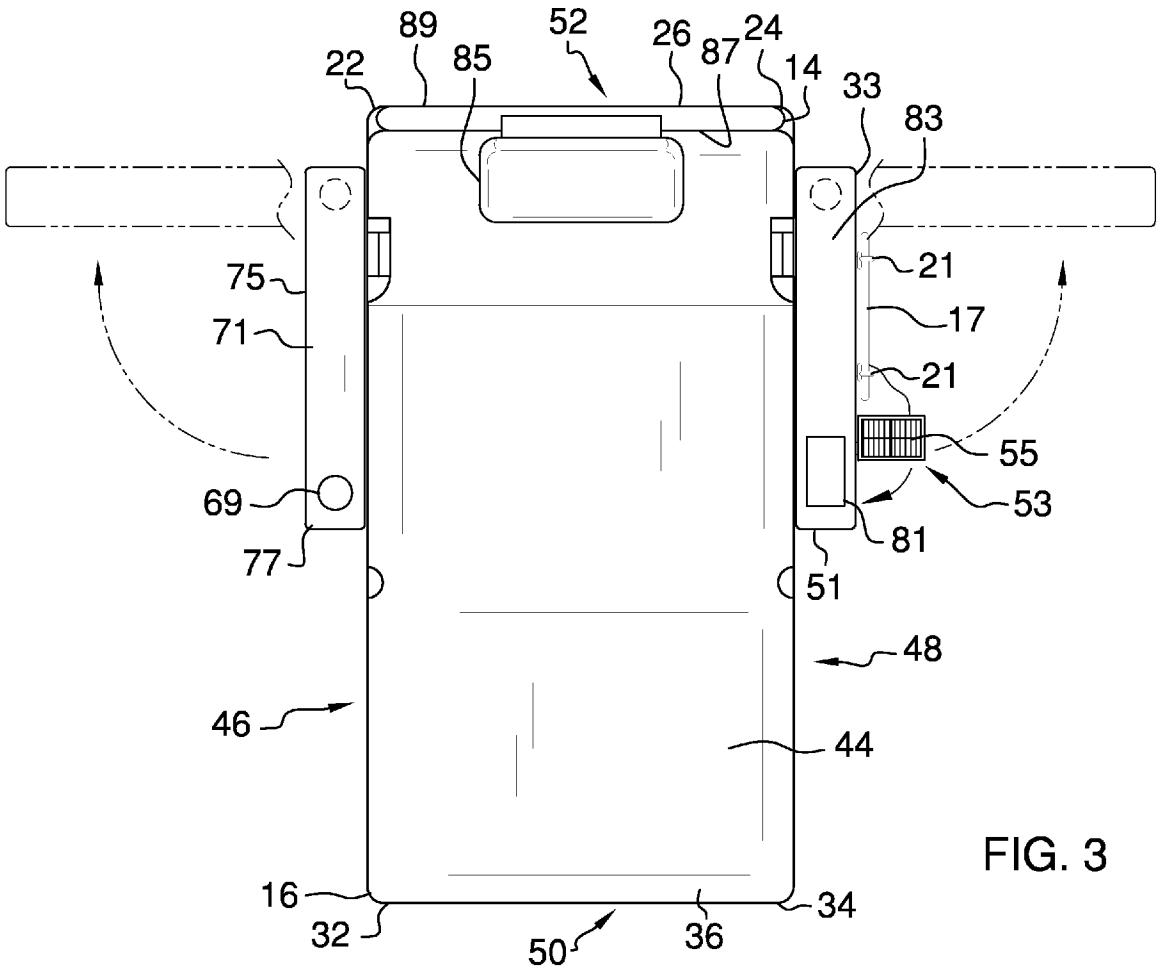
FIG. 3 is a top view of an embodiment of the disclosure.
Figure 4:
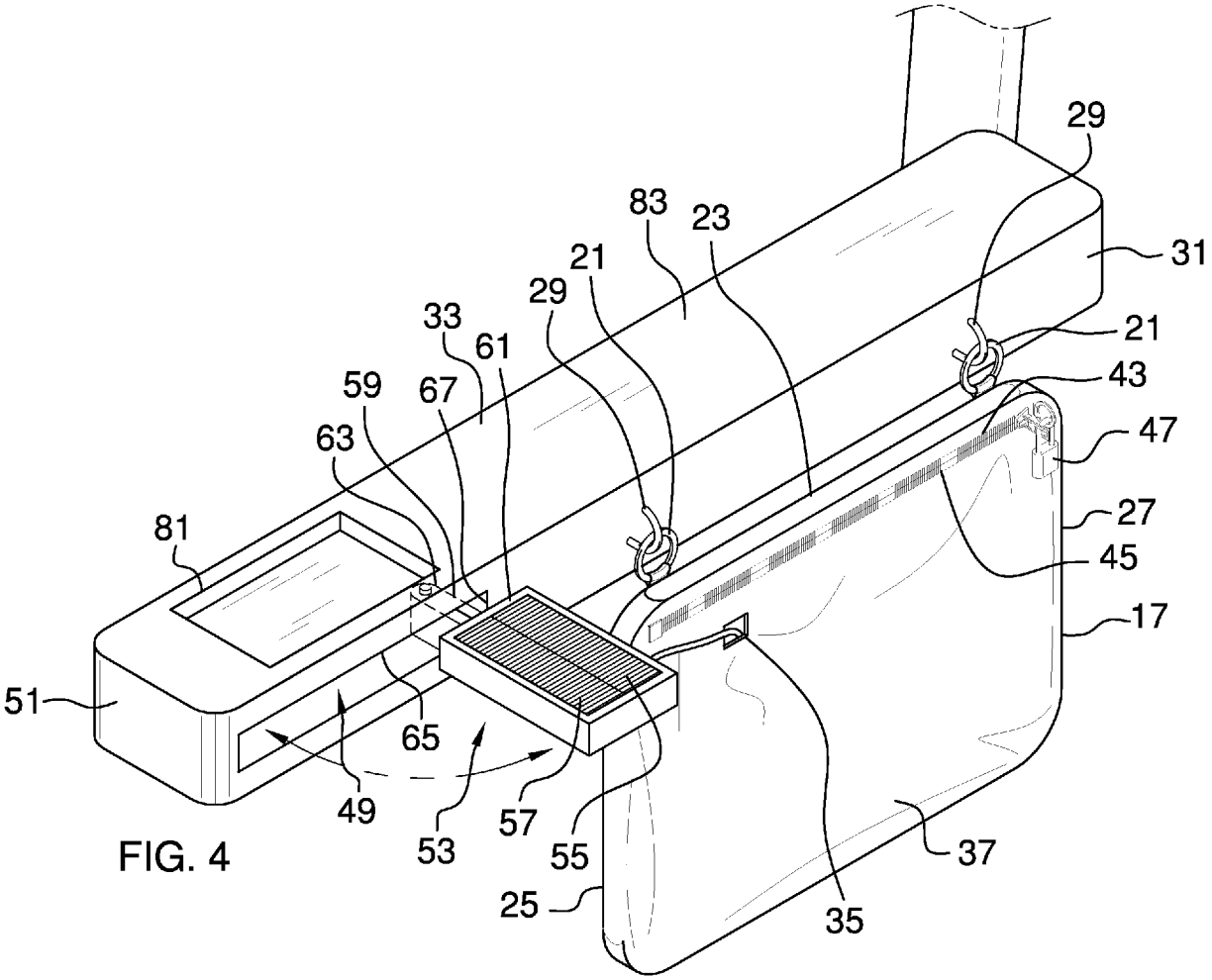
FIG. 4 is a perspective view of an embodiment of the disclosure.
Figure 5:
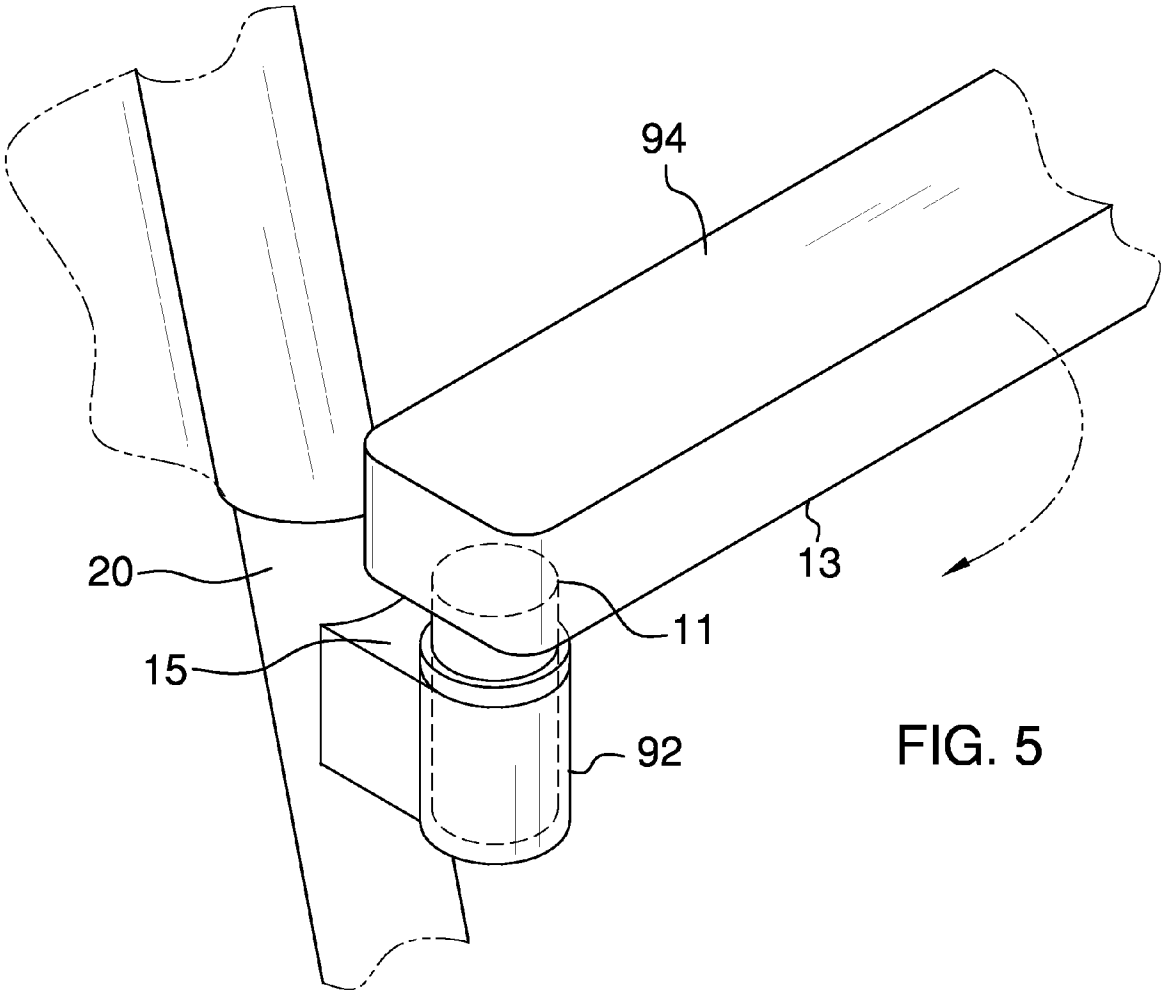
FIG. 5 is a left side perspective view of an embodiment of the disclosure.

As best illustrated in FIGS. 1 through 5, the chair assembly 10 (hereinafter assembly) generally comprises a frame 12. A back portion 14 of the frame 12 is operationally coupled to a front portion 16 of the frame 12. The back portion 14 of the frame 12 may have a length between 45 cm and 60 cm and a width between 45 cm and 60 cm. Further, the front portion 16 of the frame 12 may have a length between 90 cm and 122 cm and a width between 45 cm and 60 cm. The back portion 14 of the frame 12 comprises a first lateral arm 18 of the back portion 14 of the frame 12 and a second lateral arm 20 of the back portion 14 of the frame 12 each coupled to and extending rearwardly away from an associated one of a first end 22 and a second end 24 of a back arm 26 of the back portion 14 of the frame 12. Lastly, the front portion 16 of the frame 12 comprises a first lateral arm 28 of the front portion 16 of the frame 12 and a second lateral arm 30 of the front portion 16 of the frame 12 each coupled to and extending rearwardly away from an associated one of a first end 32 and a second end 34 of a front arm 36 of the front portion 16 of the frame 12.

A free end 38 of each of the first 18 and second 20 lateral arms of the back portion 14 of the frame 12 is hingedly coupled to a free end 40 of an associated one of each of the first 28 and second 30 lateral arms of the front portion 16 of the frame 12. The back portion 14 of the frame 12 is positionable in an upright position wherein the back portion 14 of the frame 12 extends upwardly from the front portion 16 of the frame 12. Continuing, the back portion 14 of the frame 12 is postionable in a flat position so the back portion 14 of the frame 12 extends rearwardly from the front portion 16 of the frame 12. The free end 38 of each of the first 18 and second 20 lateral arms of the back portion 14 of the frame 12 comprises a retaining hinge 42. Each of the retaining hinges 42 retains the back portion 14 of the frame 12 at a selected angle with respect to the front portion 16 of the frame 12.

A supporting panel 44 is coupled to the front 16 and back 14 portions of the frame 12. The supporting panel 44 is wrapped around each of the first lateral 28, the second lateral 30 and the front arm 36 of the front portion 16 of the frame 12 and the first lateral 18, the second lateral 20 and the back arm 26 of the back portion 14 of the frame 12. The supporting panel 44 may support a user. Moreover, the supporting panel 44 extends between a first lateral side 46, a second lateral side 48, a front side 50 and a back side 52 of the frame 12. The supporting panel 44 may be comprised of a deformable material such as canvas or other similar material.

A top end 54 of a top portion 56 of a leg 58 is coupled to a bottom 60 of the frame 12. Further, a bottom portion 62 of the leg 58 is slidably coupled to the top portion 56 of the leg 58. The leg 58 has a telescopically adjustable length so a bottom end 64 of the bottom portion 62 of the leg 58 abuts a support surface 66. Moreover, the leg 58 may be adjustable between a maximum length and a minimum length that may range between 30 cm and 60 cm. Finally, the leg 58 supports the frame 12 above the support surface 66.

A plurality of adjustment apertures 68 extends through an outer surface 70 of the top portion 56 of the leg 58. The plurality of adjustment apertures 68 is evenly distributed between the top end 54 and a bottom end 72 of the top portion 56 of the leg 58. Further, a retainer 74 is movably coupled to the bottom portion 62 of the leg 58. The retainer 74 extends outwardly through a selected one of the plurality of adjustment apertures 68. Additionally, the retainer 74 retains the leg 58 at the selected length.

The leg 58 is one of a plurality of the legs 58. The plurality of legs 58 comprises a pair of sets of the legs 76. A first one of the pair of sets of the legs 78 is evenly distributed between a coupled end 80 and the free end 40 of the first lateral arm 28 of the front portion 16 of the frame 12. Additionally, a second one of the pair of sets of the legs 84 is evenly distributed between a coupled end 86 and the free end 40 of the second lateral arm 30 of the front portion 16 of the frame 12. A foot 90 is coupled to the bottom end 64 of the bottom portion 62 of each of the plurality of legs 84.

A pivot 92 is coupled to and extends laterally away from the back portion 14 of the frame 12. The pivot 92 is one of a pair of pivots 92 each positioned on an associated one of the first lateral arm 18 and the second lateral arm 20 of the back portion 14 of the frame 12. An arm rest 94 is operationally coupled to the frame 12. The arm rest 94 may support the user's arm. Further, the arm rest 94 is elongated along a longitudinal axis extending between a first end 96 and a second end 98 of the arm rest 94. Lastly, the arm rest 94 may have a length between 30 cm and 45 cm and a width between 7 cm and 10 cm.

A cylindrical coupler 11 is coupled to and extends downwardly from a bottom side 13 of the arm rest 94 proximate the first end 96 of the arm rest 94. The cylindrical coupler 11 extends downwardly into a top side 15 of the pivot 92. Further, the arm rest 94 is rotatably coupled to the pivot 92. The arm rest 94 is positionable at a selected angle with respect to the back portion 14 of the frame 12. Lastly, the cylindrical coupler 11 may have a length between 2 cm and 4 cm. The arm rest 94 is one of a pair of the arm rests 94. Each of the pair of arm rests 94 is rotatably coupled to an associated one of the pair of pivots 92.

A bag 17 is coupled to the arm rest 94 so the bag 17 may contain an electronic device 19. The bag 17 may have a length between 20 cm and 30 cm and a height between 15 cm and 20 cm. A ring 21 is coupled to a top side 23 of the bag 17. The ring 21 is one of a pair of the rings 21 each positioned proximate an associated one of a first lateral side 25 and a second lateral side 27 of the bag 17. Each of the pair of rings 21 is coupled to an associated pair of retainers 29 each coupled to and extending laterally away from a first lateral side 31 of a second one of the pair of arm rests 33 so the bag 17 is retained on the second arm rest 33.

A cord opening 35 extends through a front side 37 of the bag 17 proximate an intersection of the first lateral side 25 of the bag 17 and the top side 23 of the bag 17. A charge cord 41 for the electronic device 19 is extendable through the cord opening 35. A coupler 43 is coupled to and extends laterally across an opening 45 in the front side 37 of the bag 17. The coupler 43 selectively opens and closes the bag 17. Moreover, the coupler 43 may be a zipper of any conventional design. A lock 47 is coupled to the coupler 43 so the coupler 43 may be locked in a closed position.

A charger well 49 extends into the first lateral side 31 of the second arm rest 33 proximate a second end 51 of the second arm rest 33. The charger well 49 may have a depth between 5 cm and 8 cm, a width between 10 cm and 15 cm and a height between 12 mm and 25 mm. A charger 53 is operationally coupled to the second arm rest 33. The charger 53 is selectively electrically coupled to the charge cord 41 for the electronic device 19 so the charger 53 may charge the electronic device 19. Moreover, the charger 53 has a width that is greater than a length of the charger 53 so the charger 53 has a rectangular shape.

A panel 55 is coupled to a top side 57 of the charger 53. The panel 55 covers a majority of the top side 57 of the charger 53. Moreover, the panel 55 may be a solar panel of any conventional design. A hinge arm 59 is coupled to and extends laterally away from a first end 61 of the charger 53. Further, a coupled end 63 of the hinge arm 59 is rotatably coupled to a top wall 65 of the charger well 49 proximate a rear wall 67 of the charger well 49. The charger 53 is rotatably coupled to the second arm rest 33.

The charger 53 is positionable in a deployed position so the charger 53 extends laterally away from the second arm rest 33. The panel 55 is exposed to sunlight when the charger 53 is in the deployed position. Further, the panel 55 generates an electrical voltage so the electronic device 19 is charged when the electronic device 19 is electrically coupled to the charger 53. Additionally, the charger 53 is positionable in a stored position so the charger 53 is positioned within the charger well 49.

A container aperture 69 extends through a top side 71 and a bottom side 73 of a first one of the pair of arms rests 75 proximate a second end 77 of the first arm rest 75. A container holder 79 is coupled to the bottom side 73 of the first arm rest 75. The container holder 79 is aligned with the container aperture 69. Additionally, a storage well 81 extends downwardly into a top side 83 of the second arm rest 33 proximate the second end 51 of the second arm rest 33. The storage well 81 may contain items.

A pillow 85 is coupled to the supporting panel 44 proximate the back arm 26 of the back portion 14 of the frame 12. The pillow 85 is positioned on the supporting panel 44. Additionally, the pillow 85 is positionable in a deployed position so the pillows 85 abuts a front side 87 of the supporting panel 44. Lastly, the pillow 85 is positionable in a stored position so the pillow 85 abuts a back side 89 of the supporting panel 44.

In use, the back portion 14 of the frame 12 is positioned at the selected angle with respect to the front portion 16 of the frame 12. Continuing, the assembly 10 may be used indoors or outdoors. The bag 17 may be used to contain any object other than the electronic device 19. Further, the lock 47 serves to prevent the electronic device 19 from being stolen. Lastly, once the electronic device 19 has been fully charged by the charger 53, the charge cord 41 may be disconnected from the charger 53.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A chair assembly for selectively charging an electronic device, said assembly comprising:

a frame comprising a back portion of said frame operationally coupled to a front portion of said frame;

a supporting panel coupled to said frame wherein said supporting panel is configured to support a user;

a leg coupled to said frame, said leg abutting a support surface wherein said leg supports said frame above the support surface;

an arm rest operationally coupled to said frame wherein said arm rest is configured to support the user's arm;

a bag coupled to said arm rest wherein said bag is configured to contain the electronic device; and a charger operationally coupled to said arm rest, said charger being selectively operationally coupled to the electronic device wherein said charger is configured to charge the electronic device;

a pivot coupled to and extending laterally away from said back portion of said frame;

said pivot being one of a pair of pivots each positioned on an associated one of a first lateral arm and a second lateral arm of said back portion of said frame;

said arm rest being elongated along a longitudinal axis extending between a first end and a second end of said arm rest;

a cylindrical coupler coupled to and extending downwardly from a bottom side of said arm rest proximate said first end of said arm rest;

said cylindrical coupler extending downwardly into a top side of said pivot wherein said arm rest is rotatably coupled to said pivot wherein said arm rest is positionable at a selected angle with respect to said back portion of said frame;

said arm rest being one of a pair of said arm rests; and each of said pair of arm rests being rotatably coupled to an associated one of said pair of pivots.

2. The assembly according to claim 1 wherein said front portion of said frame comprising a first lateral arm of said front portion of said frame and a second lateral arm of said front portion of said frame each coupled to and extending rearwardly away from an associated one of a first end and a second end of a front arm of said front portion of said frame.

3. The assembly according to claim 1 wherein said back portion of said frame comprising a first lateral arm of said back portion of said frame and a second lateral arm of said back portion of said frame each coupled to and extending rearwardly away from an associated one of a first end and a second end of a back arm of said back portion of said frame.

4. The assembly according to claim 1 wherein a free end of each of a first lateral arm and a second lateral arm of said back portion of said frame being hingedly coupled to a free end of an associated one of each of a first lateral arm and a second lateral arm of a front portion of said frame.

5. The assembly according to claim 1 wherein said back portion of said frame being positionable in an upright position wherein said back portion of said frame extends upwardly from a front portion of said frame.

6. The assembly according to claim 1 wherein said back portion of said frame being postionable in a flat position wherein said back portion of said frame extends rearwardly from said front portion of said frame.

7. The assembly according to claim 1 wherein said supporting panel being coupled to said front and back portions of said frame wherein said supporting panel is wrapped around each of a first lateral, a second lateral and a front arm of said front portion of said frame and a first lateral, a second lateral and a back arm of said back portion of said frame.

8. The assembly according to claim 7 wherein said supporting panel extends between a first lateral side, a second lateral side, a front side and a back side of said frame.

9. The assembly according to claim 1 wherein a top end of a top portion of said leg being coupled to a bottom of said frame.

10. The assembly according to claim 1 wherein a bottom portion of said leg being slidably coupled to a top portion of said leg wherein said leg has a telescopically adjustable length wherein a bottom end of said bottom portion of said leg abuts the support surface.

11. The assembly according to claim 1 wherein said leg being one of a plurality of said legs.

12. The assembly according to claim 11 wherein said plurality of legs comprising a pair of sets of said legs.

13. The assembly according to claim 12 wherein a first one of said pair of sets of said legs being evenly distributed between a coupled end and a free end of a first lateral arm of said front portion of said frame.

14. The assembly according to claim 12 wherein a second one of said pair of sets of said legs being evenly distributed between a coupled end and a free end of a second lateral arm of said front portion of said frame.

15. The assembly according to claim 1 wherein:

a ring coupled to a top side of said bag;

said ring being one of a pair of said rings each positioned proximate an associated one of a first lateral side and a second lateral side of said bag;

each of said rings being coupled to an associated pair of retainers each coupled to and extending laterally away from a first lateral side of a second arm rest wherein said bag is retained on said second arm rest; and a coupler coupled to and extending laterally across an opening in a front side of said bag wherein said coupler selectively opens and closes said bag.

16. The assembly according to claim 1 wherein:

a charger well extending into a first lateral side of a second arm rest proximate a second end of said second arm rest;

said charger having a width being greater than a length of said charger wherein said charger has a rectangular shape;

a panel coupled to a top side of said charger wherein said panel covers a majority of said top side of said charger;

a hinge arm coupled to and extending laterally away from a first end of said charger;

a coupled end of said hinge arm being rotatably coupled to a top wall of said charger well proximate a rear wall of said charger well wherein said charger is rotatably coupled to said second arm rest;

said charger being positionable in a deployed position wherein said charger extends laterally away from said second arm rest; and said charger being positionable in a stored position wherein said charger is positioned within said charger well.

17. The assembly according to claim 1 wherein a pillow coupled to said supporting panel proximate a back arm of said back portion of said frame wherein said pillow is positioned on said supporting panel.

18. The assembly according to claim 17 wherein:

said pillow being positionable in a deployed position wherein said pillow abuts a front side of said supporting panel; and said pillow being positionable in a stored position wherein said pillow abuts a back side of said supporting panel.

19. A chair assembly for selectively charging an electronic device, said assembly comprising:

a frame comprising a back portion of said frame operationally coupled to a front portion of said frame;

said back portion of said frame comprising a first lateral arm of said back portion of said frame and a second lateral arm of said back portion of said frame each coupled to and extending rearwardly away from an associated one of a first end and a second end of a back arm of said back portion of said frame;

said front portion of said frame comprising a first lateral arm of said front portion of said frame and a second lateral arm of said front portion of said frame each coupled to and extending rearwardly away from an associated one of a first end and a second end of a front arm of said front portion of said frame;

a free end of each of said first and second lateral arms of said back portion of said frame being hingedly coupled to a free end of an associated one of each of said first and second lateral arms of said front portion of said frame;

said back portion of said frame being positionable in an upright position wherein said back portion of said frame extends upwardly from said front portion of said frame, said back portion of said frame being positionable in a flat position wherein said back portion of said frame extends rearwardly from said front portion of said frame;

a supporting panel coupled to said front and back portions of said frame wherein said supporting panel is wrapped around each of said first lateral, said second lateral and said front arm of said front portion of said frame and said first lateral, said second lateral and said back arm of said back portion of said frame wherein said supporting panel extends between a first lateral side, a second lateral side, a front side and a back side of said frame wherein said supporting panel is configured to support a user;

a top end of a top portion of a leg being coupled to a bottom of said frame, a bottom portion of said leg being slidably coupled to said top portion of said leg wherein said leg has a telescopically adjustable length wherein a bottom end of said bottom portion of said leg abuts the support surface wherein said leg supports said frame above the support surface, said leg being one of a plurality of said legs, said plurality of legs comprising a pair of sets of said legs;

a first one of said pair of sets of said legs being evenly distributed between a coupled end and a free end of said first lateral arm of said front portion of said frame;

a second one of said pair of sets of said legs being evenly distributed between a coupled end and a free end of said second lateral arm of said front portion of said frame;

a pivot coupled to and extending laterally away from said back portion of said frame, said pivot being one of a pair of pivots each positioned on an associated one of said first lateral arm and said second lateral arm of said back portion of said frame;

an arm rest operationally coupled to said frame wherein said arm rest is configured to support the user's arm, said arm rest being elongated along a longitudinal axis extending between a first end and a second end of said arm rest;

a cylindrical coupler coupled to and extending downwardly from a bottom side of said arm rest proximate said first end of said arm rest, said cylindrical coupler extending downwardly into a top side of said pivot wherein said arm rest is rotatably coupled to said pivot wherein said arm rest is positionable at a selected angle with respect to said back portion of said frame;

said arm rest being one of a pair of said arm rests;

each of said pair of arm rests being rotatably coupled to an associated one of said pair of pivots;

a bag coupled to said arm rest wherein said bag is configured to contain the electronic device;

a ring coupled to a top side of said bag, said ring being one of a pair of said rings each positioned proximate an associated one of a first lateral side and a second lateral side of said bag, each of said rings being coupled to an associated pair of retainers each coupled to and extending laterally away from a first lateral side of said second arm rest wherein said bag is retained on said second arm rest;

a coupler coupled to and extending laterally across an opening in a front side of said bag wherein said coupler selectively opens and closes said bag;

a charger well extending into said first lateral side of said second arm rest proximate a second end of said second arm rest;

a charger operationally coupled to said arm rest, said charger being selectively electrically coupled to the electronic device wherein said charger is configured to charge the electronic device, said charger having a width being greater than a length of said charger wherein said charger has a rectangular shape;

a panel coupled to a top side of said charger wherein said panel covers a majority of said top side of said charger;

a hinge arm coupled to and extending laterally away from a first end of said charger, a coupled end of said hinge arm being rotatably coupled to a top wall of said charger well proximate a rear wall of said charger well wherein said charger is rotatably coupled to said second arm rest;

said charger being positionable in a deployed position wherein said charger extends laterally away from said second arm rest, said charger being positionable in a stored position wherein said charger is positioned within said charger well; and a pillow coupled to said supporting panel proximate said back arm of said back portion of said frame wherein said pillow is positioned on said supporting panel, said pillow being positionable in a deployed position wherein said pillow abuts a front side of said supporting panel, said pillow being positionable in a stored position wherein said pillow abuts a back side of said supporting panel.

* * * * *